US007559719B2

(12) United States Patent
Nasby

(10) Patent No.: US 7,559,719 B2
(45) Date of Patent: Jul. 14, 2009

(54) SCREED ATTACHMENT FOR SKID STEER VEHICLE

(76) Inventor: Victor B. Nasby, P.O. Box 235, Milroy, IN (US) 46156

( * ) Notice: Subject to any disclaimer, the term of this patent is extended or adjusted under 35 U.S.C. 154(b) by 12 days.

(21) Appl. No.: 11/746,496

(22) Filed: May 9, 2007

(65) Prior Publication Data

US 2008/0279629 A1 Nov. 13, 2008

(51) Int. Cl.
*E01C 19/22* (2006.01)

(52) U.S. Cl. ..... 404/96; 404/118

(58) Field of Classification Search ..... 404/96, 404/114, 118
See application file for complete search history.

(56) References Cited

U.S. PATENT DOCUMENTS

| | | | | |
|---|---|---|---|---|
| 4,655,633 | A | 4/1987 | Somero et al. | |
| 4,978,246 | A | 12/1990 | Quenzi et al. | |
| 5,190,396 | A * | 3/1993 | Aoyagi et al. | 404/84.5 |
| 6,022,171 | A * | 2/2000 | Munoz | 404/124 |
| 6,168,348 | B1 * | 1/2001 | Meyer et al. | 404/90 |
| 6,183,160 | B1 * | 2/2001 | Tapio et al. | 404/84.1 |
| 6,203,244 | B1 | 3/2001 | Van Ornum | |
| 6,322,287 | B1 * | 11/2001 | Yelton | 404/118 |
| 6,543,962 | B2 | 4/2003 | Wells | |
| 6,609,547 | B1 | 8/2003 | Machkovech | |
| 6,662,881 | B2 | 12/2003 | Domann | |
| 6,685,390 | B1 | 2/2004 | Eitzen | |
| 6,758,631 | B2 | 7/2004 | Frankeny, II | |
| 6,851,486 | B2 | 2/2005 | Marshall | |
| 7,044,681 | B2 | 5/2006 | Quenzi et al. | |
| 7,104,723 | B2 | 9/2006 | Holmes | |
| 7,121,762 | B2 | 10/2006 | Quenzi et al. | |
| 7,153,058 | B2 | 12/2006 | Lindley | |
| 2003/0161684 | A1 * | 8/2003 | Quenzi | 404/75 |

* cited by examiner

*Primary Examiner*—Gary S Hartmann
(74) *Attorney, Agent, or Firm*—Maginot, Moore & Beck LLP

(57) ABSTRACT

A screed attachment is provided for an industrial vehicle, such as a skid steer vehicle. The attachment includes a pair of extendable beam assemblies and a mounting structure configured to support the beam assemblies on the forward attachment point of the vehicle. The beam assemblies are set apart sufficient for the skid steer to drive between the assemblies to engage the mounting structure. Legs are provided to support the beam assemblies when the screed attachment is in use. The screed attachment includes a screed plate supported by the extendable beam of the beam assemblies so that the screed plate can be extended over a concrete pour and retracted along the pour to perform the screeding operation. The screed plate is vertically adjustable and may be under the control of a laser leveling system.

16 Claims, 6 Drawing Sheets

SCREED ATTACHMENT FOR SKID STEER VEHICLE

BACKGROUND

The present invention relates to apparatuses for screeding poured concrete and to attachments for skid steer or industrial utility vehicles.

Concrete screeds are used in the concrete industry to level freshly poured concrete. A wide variety of screeding implements or apparatuses are available ranging from manually operable lightweight screed to large-scale truss screeds. Mobile screeds are known that travel along the underlying substrate as the concrete is poured. More recent advances have improved the flatness and levelness of newly screeded concrete. In particular, laser leveling systems have been developed in which a planar reference laser used to position guide bars along which a screed travels to level the concrete. In another approach, a trowel may be used on the poured concrete to form guide lanes at the proper level along which the screed travels. Systems of this type are often used in road construction.

Accuracy, even under laser guidance, is difficult for the true manual screed, since these apparatuses rely upon the strength and coordination of the operator(s). Other screeds have been developed that are carried by utility vehicles, such as the apparatus disclosed in U.S. Pat. No. 6,203,244. In that apparatus, a screed attachment is pulled by the utility vehicle across the newly-poured slab. In this respect, the apparatus disclosed in the '244 patent is similar to other systems in which a screed platform is pulled by a vehicle. In particular, systems of this type require a smooth surface on which the vehicle is driven in order to ensure a smooth and level screed behind the vehicle.

Non-mobile systems are known that do not rely upon a vehicle pulling the screed platform. Instead, in these systems, the screed is supported on a telescoping boom, such as in the apparatus disclosed in U.S. Pat. No. 7,044,681. Non-mobile systems of this type avoid the need for a smooth driving surface required by the vehicle pulled screed. However this benefit is at the cost of an expensive stand-alone unit that may be cost-effective for large concrete pours but is too expensive for smaller applications, such as pouring sidewalks and patios.

Consequently, there is a need for a screed apparatus that is portable and inexpensive, but is capable of an accurate and level screeding.

SUMMARY OF THE INVENTION

In order to address the needs left by prior devices, the present invention contemplates a screed attachment for an industrial vehicle, such as a skid steer vehicle. The vehicle has an attachment point for accessories and a power mechanism for moving the attachment point. In accordance with one embodiment of the invention, the screed attachment comprises a pair of extendable beam assemblies, each assembly including a fixed beam, an extendable beam and a mechanism for extending and retracting the extendable beam relative to the fixed beam, and a mounting structure connected between the pair of extendable beam assemblies with a portion configured to engage the attachment point of the industrial vehicle. A screed plate is carried by a free end of the extendable beam of each of the extendable beam assemblies so that the screed plate can be extended over a site and retracted to screed the poured concrete.

In one feature, the screed attachment further comprises a plurality of legs with ground-engaging feet connected to the fixed beam of each of the pair of beam assemblies to support the extendable beam assemblies. The legs support the screed attachment when the attachment is in use, and are adjustable relative to the beam assemblies so that the screed plate can be pulled level with the ground during screeding. In another feature, the mounting structure includes a beam connected to the pair of extendable beam assemblies and configured to support the pair of extendable beam assemblies at a spacing sufficient for the industrial vehicle to drive between the beam assemblies. Thus, when the screed attachment is supported by the legs, the skid steer may be driven between the beam assemblies so that the attachment point is immediately adjacent the mounting structure. The power mechanism of the skid steer may be controlled to maneuver the attachment point into engagement with the mounting structure of the screed attachment. The screed attachment may then be lifted by the skid steer power mechanism as the skid steer is driven to the location of the poured concrete to be screeded.

In a further beneficial feature of certain embodiments of the invention, the mounting structure includes a mechanism for moving the screed plate vertically relative to the industrial vehicle. This mechanism may include a vertically movable piston and a drive mechanism for extending and retracting each piston connected to opposite ends of the screed plate. Alternatively, the mechanism may include an electric motor and gear drive or vertical screw mechanism for up and down pressure transfer to the concrete screed. A level sensing system is integrated into the screed attachment for comparing the vertical position of the screed plate relative to a pre-determined vertical position. This level sensing system can them be used to either manually or automatically adjust the vertical position of either or both ends of the screed to ensure a smooth and level screeding, or to screed the concrete pour at a pre-determined grade.

In yet another feature, the mounting structure includes a pair of brackets, each pivotably connected at a corresponding opposite end of the screed plate, and a pair of vertical supports connecting each of the pair of brackets with the extendable beam of a corresponding one of the pair of extendable beam assemblies. The brackets are removably mounted to the screed plate to permit removal and replacement of the plate as necessary. For instance, one screed plate may be replaced by a shorter or a longer screed plate depending upon the nature of the job site.

It is one object of the invention to provide an apparatus for screeding a concrete pour that is readily and easily accessible at any job site. A further object is to provide a screeding attachment for use on an industrial vehicle that would often be available at a residential or commercial job site, for instance.

One benefit of the screed attachment of the present invention is that it can be carried by a small industrial vehicle. A further benefit is that the screed attachment is self-extending and retracting and does not require that a vehicle be driven over the job site to tow a screed plate behind.

Still another benefit is that the attachment of the present invention can screed lower slump concrete for engineered strength specifications, without the need to add water (which inherently weakens the concrete) as is often necessary for hand-operated screeding. Other objects and benefits of the invention will become apparent upon consideration of the following written description together with the accompanying figures.

DESCRIPTION OF THE ILLUSTRATED EMBODIMENTS

Figure 1:
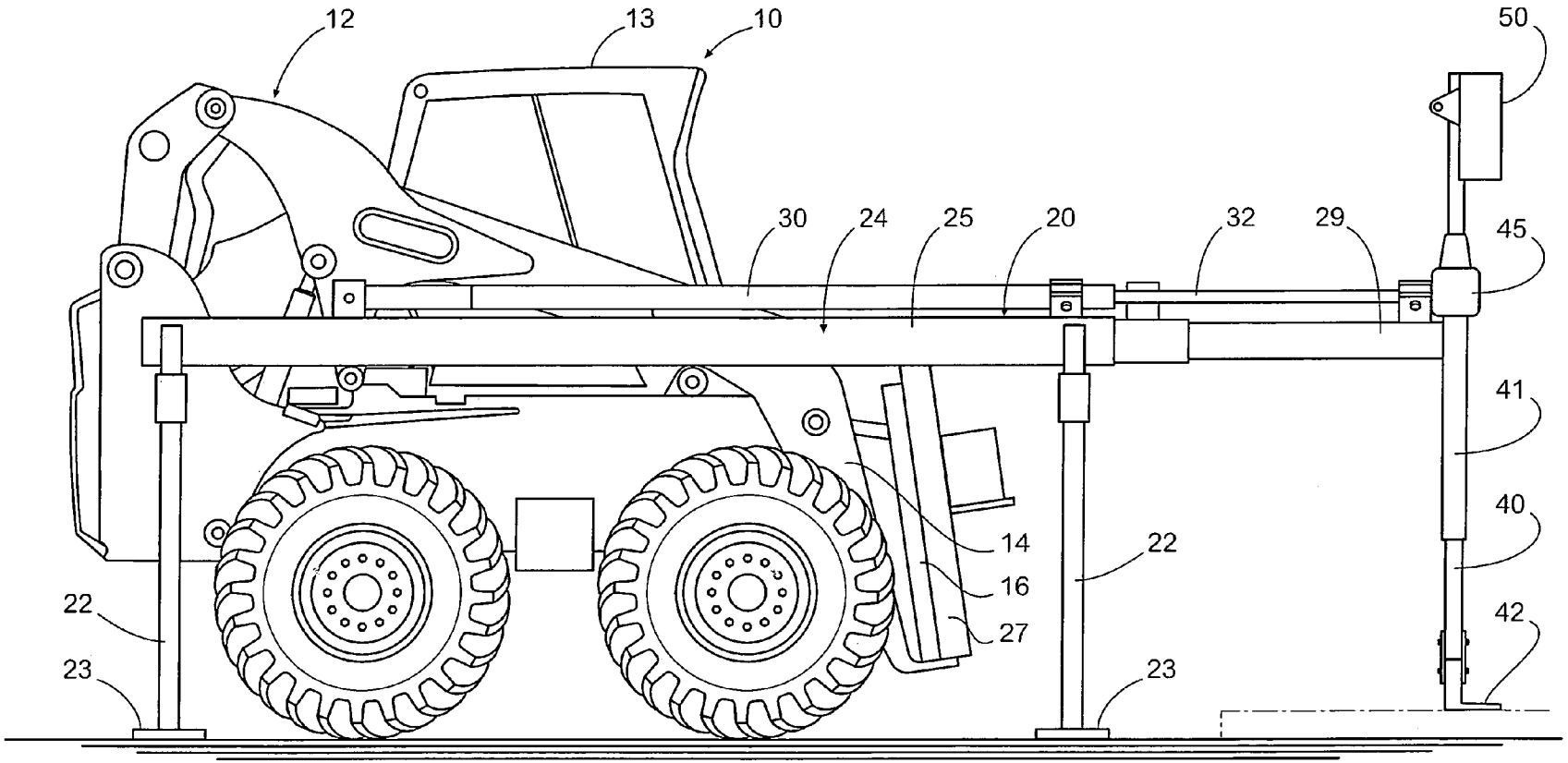
FIG. 1 is a side view of a skid steer vehicle with a screed attachment according to one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
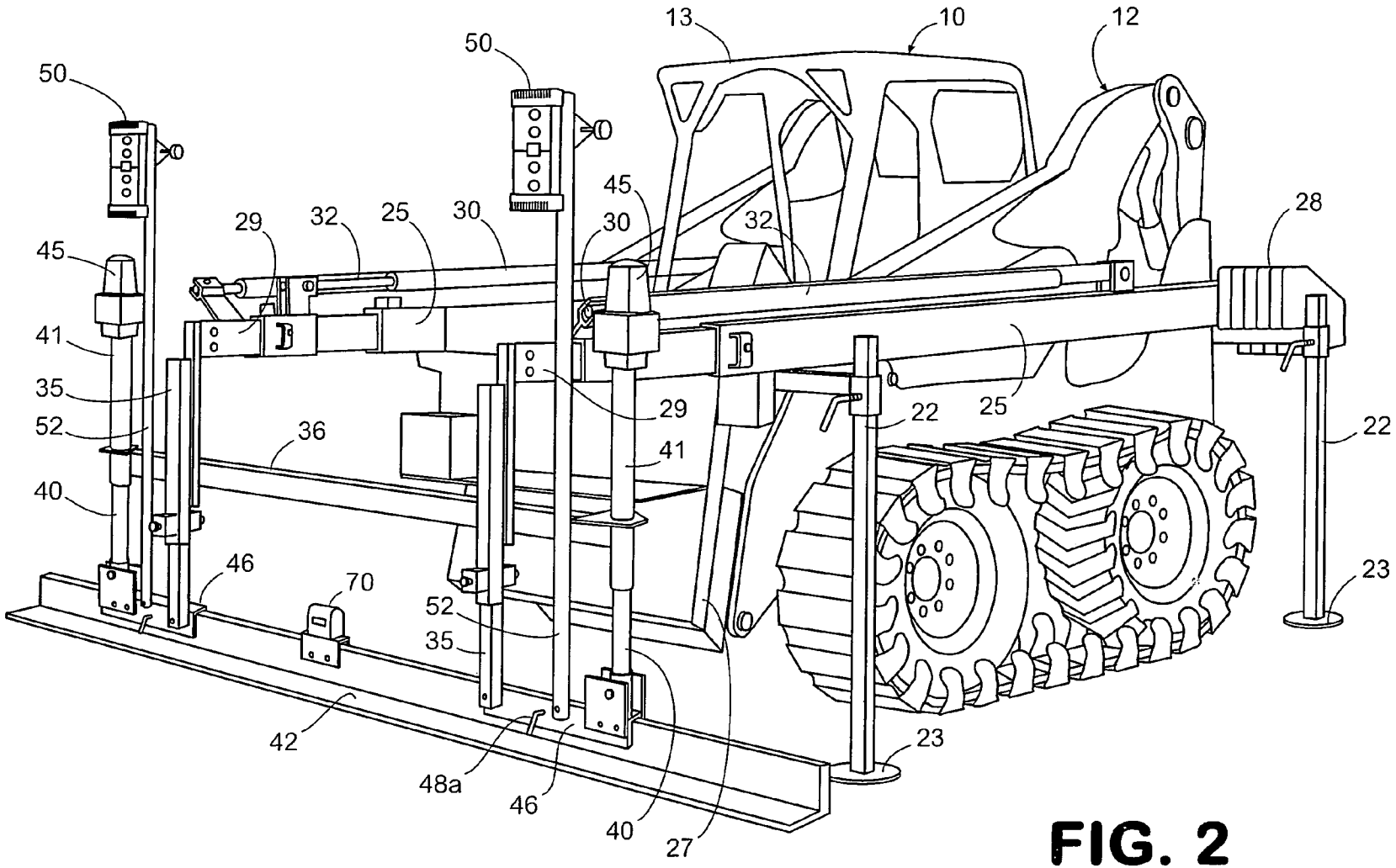
FIG. 2 is a front perspective view of the skid steer and attachment shown in FIG. 1.
Figure 4:
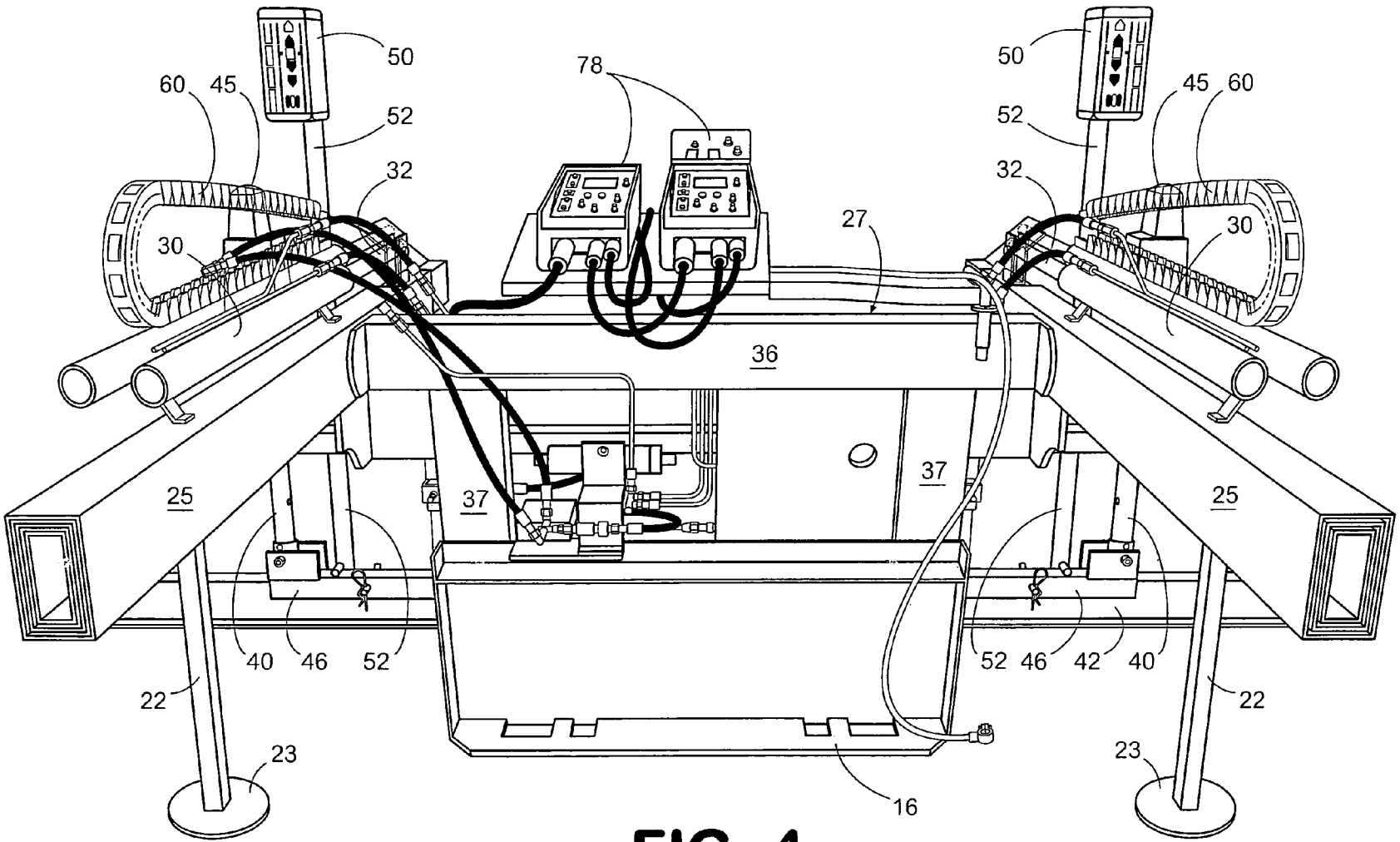
FIG. 4 is a view from within the screed attachment shown in FIG. 3.

A screed attachment 20 according to one embodiment is configured for attachment to an industrial vehicle, and especially a skid steer vehicle 10, as depicted in FIG. 1. One such suitable vehicle is the Bobcat S300, sold by Bobcat Company. The vehicle 10 includes a forward attachment point 14 that may be raised and lowered by a power mechanism 12. A protected cab 13 is provided for the vehicle operator. The vehicle 10 is self-propelled and may run on wheels, as shown in FIG. 1, or tracks, as shown in FIG. 2. The vehicle 10 may be any suitable self-propelled small industrial vehicle capable of receiving various and carrying components and attachments, such as the screed attachment 20 of the present invention. In the case of the Bobcat S300, an attachment plate 16 is configured to be easily engaged to or disengaged from the attachment point 14 without the need for tools, and most preferably simply by manipulation of the power mechanism. The attachment plate 16, as best shown in FIG. 4, may therefore be of the same configuration as attachment plates incorporated into other attachments for the particular industrial vehicle. In accordance with the illustrated embodiment of the present invention, the structure of the screed attachment 20 is suitably connected to the attachment plate 16, such as by welding and appropriate bracing.

Figure 3:
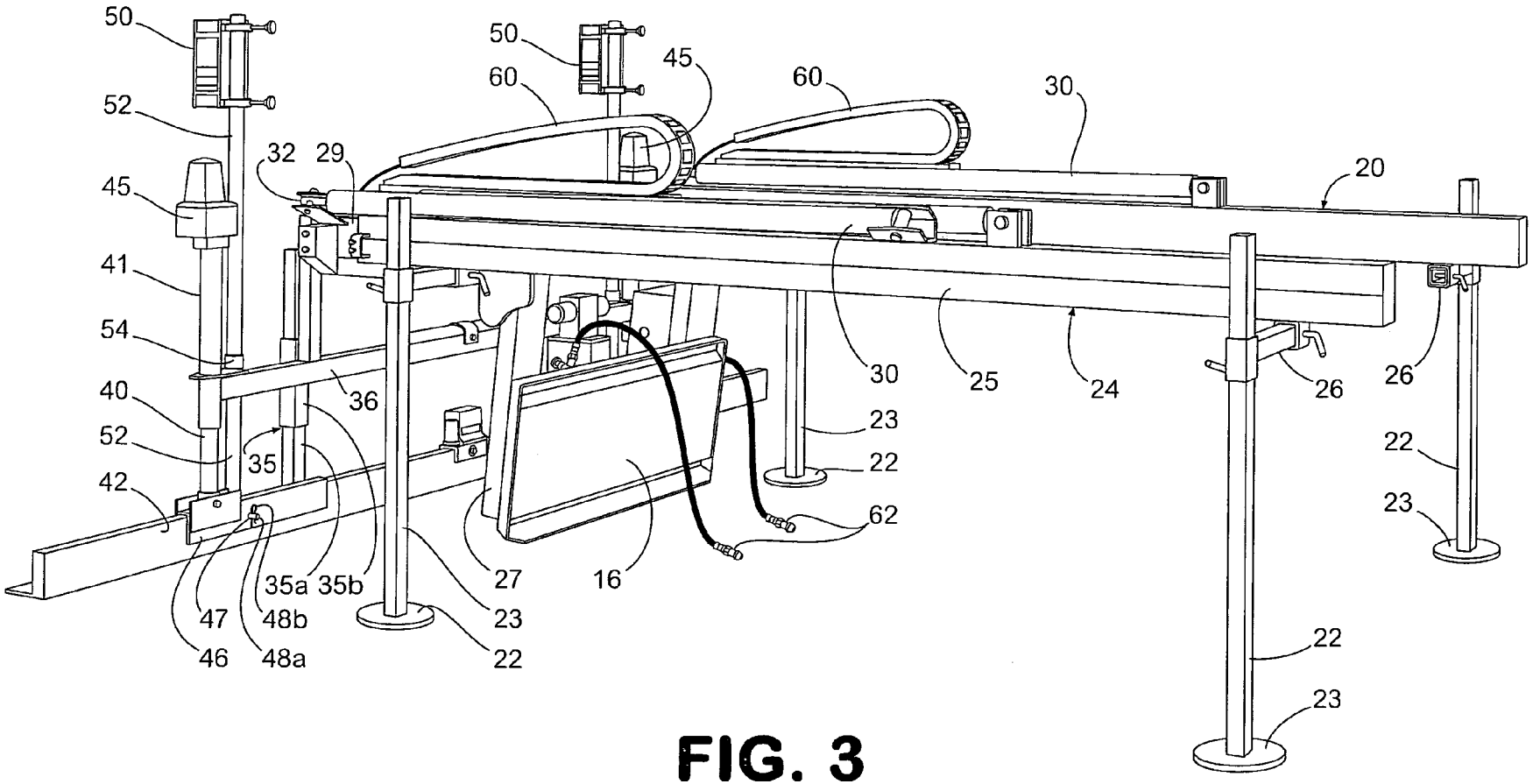
FIG. 3 is a rear perspective view of the screed attachment according to one embodiment of the invention.

Returning to FIG. 1, the screed attachment 20 includes support legs 22 with feet 23 mounted at the base of the legs. The feet 23 may be cup-type feet for supporting the attachment 20 on the ground or similar uneven surfaces. However, other configurations of feet 23 and legs 22 are contemplated provided that they are capable of stably supporting the weight of the screed attachment 20 while the attachment is operated. A pair of beam assemblies 24 each include a side beam 25 connecting the front and rear legs 22 at each side of the attachment 20, as illustrated in FIGS. 2-3. A mounting structure 27 spans between and is attached to the side beams 25 adjacent the front end of the beams. The mounting structure 27 is also attached to the attachment plate 16. In one embodiment, the mounting structure 27 includes a horizontal beam 36 spanning between the side beams 25 and vertical beams 37 connecting the beam 36 to the attachment plate 16. In the illustrated embodiment, the beams forming the mounting structure 27 are welded together and to the side beams in a suitable manner, although other forms of permanent or removable attachment are contemplated. Other forms of mounting structure 27 are also contemplated provided that they provide a solid frame for supporting the side beams 27 relative to the attachment plate 16 and for supporting other components of the screed attachment 20, as described in more detail below, during transport and operation of the attachment.

Figures 5, 6:
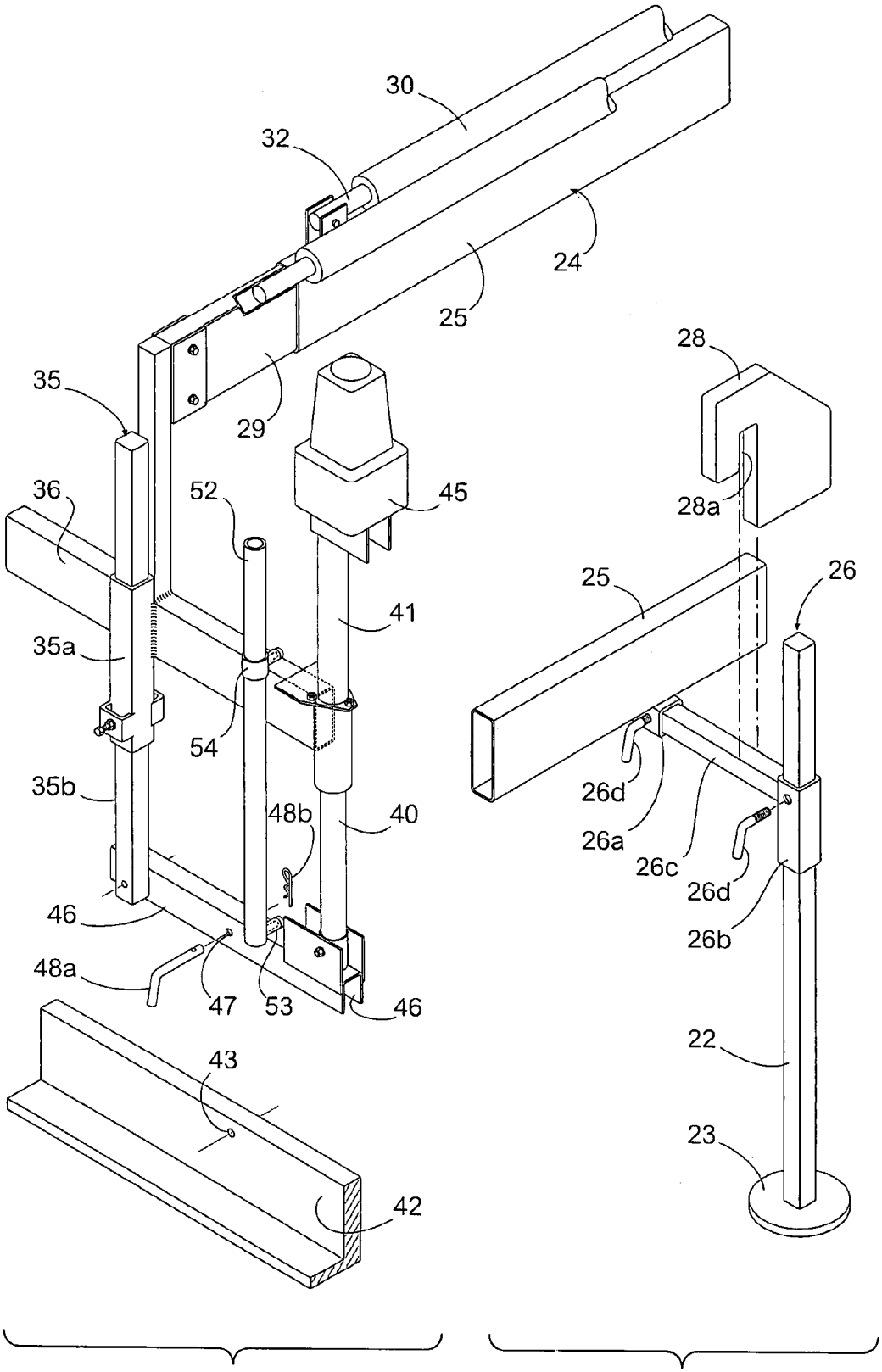
FIG. 5 is an enlarged view of a front portion of the screed attachment shown in FIGS. 3-4.
FIG. 6 is an enlarged view of a rear portion of the screed attachment shown in FIGS. 3-4.

The legs 22 of the attachment 20 are attached to the side beams 25 adjacent the front and back ends of the beams, as shown in FIGS. 1-3. While the legs 22 may be directly attached to the side beams, in the preferred embodiment the legs are attached to the side beams in a manner that permit independent adjustment of the support height of the legs. Thus, as shown in FIG. 6, each leg 22 may be attached to a corresponding end of a corresponding side beam 25 by way of an adjustable outrigger assembly 26. The outrigger assembly 26 includes a first collar **26*a* attached to the side beam 25. A second collar 26*b* is configured to be slidably mounted on the leg 22. An arm 26*c* extends from the second collar 26*b* and is configured to be slidably engaged within the first collar. A locking screw 26*d* is provided with each collar to clamp the arm 26*c* or leg 22 within the respective collar 26*a*, 26*b*. This configuration of the outrigger assembly allows for lateral and vertical adjustment of each leg 22 relative to a corresponding side beam 25. As explained in more detail below, the outrigger assembly allows adjustment of the legs to achieve substantially horizontal positioning of the side beams 25 during use of the screed attachment 20. Of course, other manner of attaching the legs 22 to the side beams 25** are contemplated provided again that they achieve a solid support structure for the working components of the screed attachment. In addition, other forms of adjustable attachment are contemplated that permit adjustment in one or more degrees of freedom.

In accordance with one feature of the invention, the mounting structure 27 is configured to maintain the side beams 25 at an established width spacing. In particular, that spacing is sized so that the vehicle 10 may be driven directly in between the side beams 25 and into the screed attachment 20. As shown in FIG. 3, the rear end of the attachment 20 is open between the side beams 25 and rear legs 22. When not in use, the screed attachment 20 may be stored standing on the legs 22. To engage the attachment to the skid steer vehicle 10, the vehicle 10 is driven between the side beams 25 until the attachment point 14 is disposed within the attachment plate 16. Appropriate manipulation of the power mechanism 12 and attachment point 14 may be sufficient to mount the attachment plate 16 on the vehicle 10. Depending upon the manner of attachment of accessories to the particular vehicle, this connection between the attachment plate 16 of the screed attachment 20 and the vehicle may be modified accordingly.

The width spacing between the side beams 25 is preferably established to fit snugly within the envelope of the vehicle 10. As shown in FIG. 2, the side beams 25 fit close to the power mechanisms 12 on either side of the cab 13 and directly above the wheels/drive track. Maintaining the side beams 25 as close to the centerline of the vehicle as possible improves the stability of the screed attachment when it is transported by the vehicle.

Once the screed attachment 20 has been engaged at the attachment point 14 of the vehicle 10, the vehicle may be used to transport the attachment to the job site. During transport, all of the working components of the attachment, including the screed plate 42 described herein, are retracted to avoid contact with the ground. Likewise, the legs 22 are retracted. It is contemplated that the power mechanism 12 may be operated to slightly raise the attachment point 14 and consequently the entire screed attachment 20. Once the attachment has been positioned adjacent the work site, the attachment point 14 can be lowered and the legs 22 can be lowered to support the screed attachment. At this point, the necessary adjustments to the vertical and lateral position of the outrigger assemblies can be made so that the side beams 25 are substantially horizontal.

As explained in more detail below, the working components of the screed attachment 20 project from the front end of the attachment. In order to maintain the stability of the structure—i.e., to prevent the structure from tipping—counter weights 28 may be provided at the rear of the screed attachment. As best shown in FIG. 6, each counter weight 28 includes a notch 28*a* that fits over the arm 26*c* of the outrigger assembly 26. The total weight supported at the rear of the structure depends upon what is necessary to counter-balance the weight of the working components at the extent of their use. In a specific embodiment, counter-weights totaling 120 lbs. are supported on the outrigger arm 26*c* on each side of the structure. In lieu of, or in addition to, the counter-weights 28, a link may be provided between the rear of the side beams and/or the rear legs to the rear of the vehicle, for added stability.

It is noted that although no transverse beam is provided at the rear of the structure, a removable beam may be provided that is interlocked with or attached to the side beams once the vehicle 10 is within the attachment. However, it is contemplated that such an additional transverse beam will not be necessary for most applications of the screed attachment 20 since the weight of the attachment may be amply supported by the power mechanism 12 of the vehicle when the attachment is being transported and since the screed attachment 20 itself is supported by the legs 22 when in use.

Figure 7:
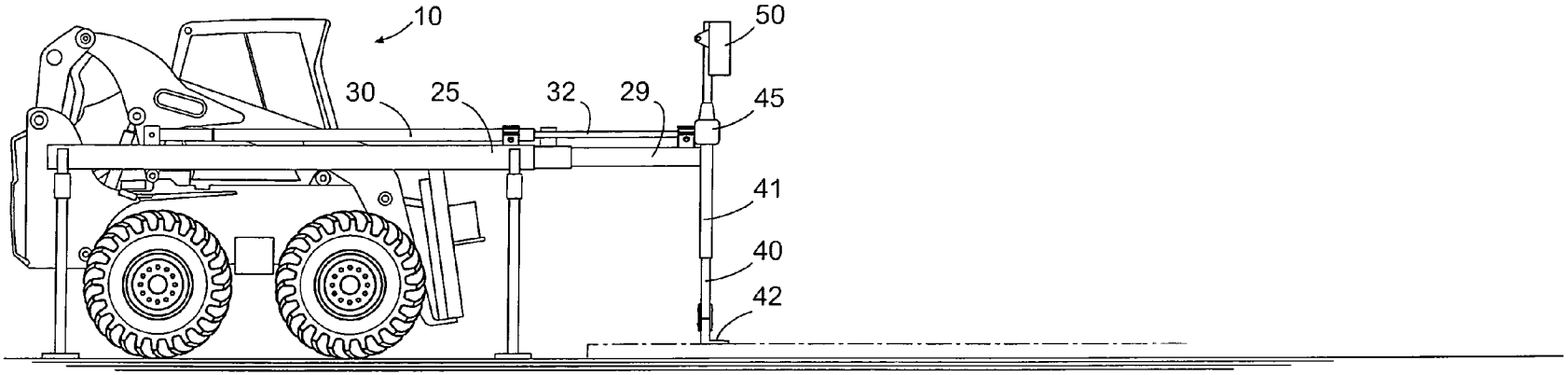
FIG. 7 is a side view of the skid steer and screed attachment with the screed plate in its retracted position.

Returning to FIGS. 1 and 2, the working components of the screed attachment 20 include an extendable beam 29 that is slidably disposed within each of the side beams 25. Appropriate bearings and guides may be incorporated between the side beam and the extendable beam to facilitate smooth extension operation. In addition, a stop may be incorporated to prevent extension of the inner beam 29 beyond a safe distance. In a specific embodiment, the screed attachment is configured for screeding a standard eight foot poured slab. Thus, the extendable beams 29 and the side beams 25 are sized so that the beams 29 may extend eight feet, in the extended position shown in FIG. 8, from the fully retracted position shown in FIGS. 2 and 7. Thus, in a specific embodiment, the beams 25 and 29 all have a length of about ten feet. In the retracted position, the extendable beams 29 may project about one foot from the end of the side beams 25. When fully extended, about two feet of the extendable beams 29 remain supported within the side beams 25. Of course, longer extensions may be achieved by lengthening the side beams and the extendable beams. In that case, additional counter-weights 28 may be necessary to counter-balance the moment arm of the fully extended beams and working components.

The extendable beams 29 are each actuated in the illustrated embodiment by a hydraulic cylinder 30 and piston 32. Each cylinder 30 is mounted on a corresponding side beam 25. The free end of each piston 32 is connected near the end of each extendable beam 29, as shown in the detail view of FIG. 5. The cylinder 30 may be coupled via hydraulic hoses 62 (FIG. 3) to the hydraulics system of the vehicle in a known manner. In the illustrated embodiment, a hydraulic extension/retraction system is utilized due to the ease of tapping into the existing vehicle hydraulics. However, it is contemplated that other extension/retraction mechanisms may be used, provided that the mechanism is capable of controlled and uniform retraction of the working end of the screed attachment, namely the screed plate 42, to ensure a uniform and smooth surface to the poured concrete. In addition, the extension mechanism must be sufficiently powerful to maintain a uniform speed as the concrete builds up behind the retracting screed plate. Hydraulic or pneumatically mechanisms may be preferred because they typically provide a great amount of control over stopping and starting and rate of retraction. However, other suitable extension/retraction mechanisms may be used, such as an electric motor with a rack and pinion transmission or a lead screw extension mechanism.

The working ends of the extendable beams 29 support the screed plate 42 to extend and retract the plate in a controlled manner. In certain embodiments, the screed plate 42 may be directly and fixedly connected to the extendable beams 29. However, such fixed connection complicates vertical adjustments of the screed plate and requires that the side beams 25 and extendable beams 29 be precisely oriented relative to the horizontal to ensure a level screeding. Moreover, a fixed screed plate makes screeding at a grade extremely problematic.

Thus, in accordance with one feature of the screed attachment of the present invention, the screed plate 42 is connected to the working end of the extendable beams 29 in a manner that permits on-the-fly vertical adjustment, as well as ready removal and replacement. This connection is accomplished in the illustrated embodiment, best seen in FIG. 5, through vertical support 35 including a vertical tube 35*a* that is fastened to a horizontal beam 36. A stiffening or stabilizing element, such as an adjustable turnbuckle mechanism, may be incorporated between the tube 35*a* and the beam 29. The horizontal beam 36 spans beyond the width spacing of the side beams. A telescoping tube 35*b* is slidingly disposed within the tube 36*a* to free slide in the vertical degree of freedom. The end of the telescoping tube 35*b* is pivotably connected to a mounting bracket 46.

A vertical cylinder 41 is mounted at each end of the horizontal beam 36. A vertical piston 40 extends from the cylinder and is driven by a motor 45 at the top of the cylinder. Since the vertical cylinder is extended with the extendable beams 29, it is preferable that the motor be an electric motor, rather than a hydraulic/pneumatic mechanism. The motor 45 is preferable capable of precise adjustment of the vertical position of the screed plate 42, especially when used in conjunction with the laser leveling components discussed herein. The vertical piston is preferably capable of sufficient vertical travel so that the screed plate may be retracted well above ground level for transport of the screed attachment by the vehicle 10. It can be appreciated that as the piston 40 is extended or retracted, the tube 35*b* slides freely within the vertical tube 35*a* providing the structural link to the working end of the extendable beams 29.

The end of the piston 40 is pivotably connected to the mounting bracket 46. The telescoping tube 35*b* and piston 40 are connected to the bracket at opposite ends thereof, equidistant from a mounting bore 47. The mounting bore aligns with a bore 43 formed in the vertical portion of the screed plate 42, as seen in FIG. 5. An angle pin 48*a* extends through the two aligned bores and is held in position by a cotter pin 48*b* to connect the mounting bracket 46 to the screed plate 42. The angle pin/cotter pin connection provides a quick and easy way of removing and replacing the screed plate 42 as needed.

As shown in FIG. 2, a mounting bracket 46 and pin 48*a* support the screed plate 42 at two locations. The pin connection may provide a limited amount of "play" between the screed plate and the bracket. This play works in association with a vibrator assembly 70 mounted to the screed plate generally at the middle of the plate. The vibrator assembly induces a small amplitude, high frequency vibration of the screed plate to facilitate the movement of the plate across the poured concrete and to impart some compaction to the concrete. The mounting bracket and pin help isolate the cylinder 41 and mounting structure from this vibration.

As indicated above, the preferred embodiment of the screed attachment 20 of the present invention incorporates laser guidance capabilities. In the embodiment shown in FIGS. 1-4, laser sensors 50 are mounted on posts 52 that are supported on the mounting brackets 46 (as shown in FIG. 5). Each post 52 may be fixed to a corresponding bracket, but in a preferred embodiment the posts 52 are only supported on the bracket by a peg 53 and a collar 54 fixed to the horizontal beam 36 so that the posts can translate vertically relative to the beam. This peg support allows the posts and sensors 50 to be removed and re-mounted as needed.

Figure 8:
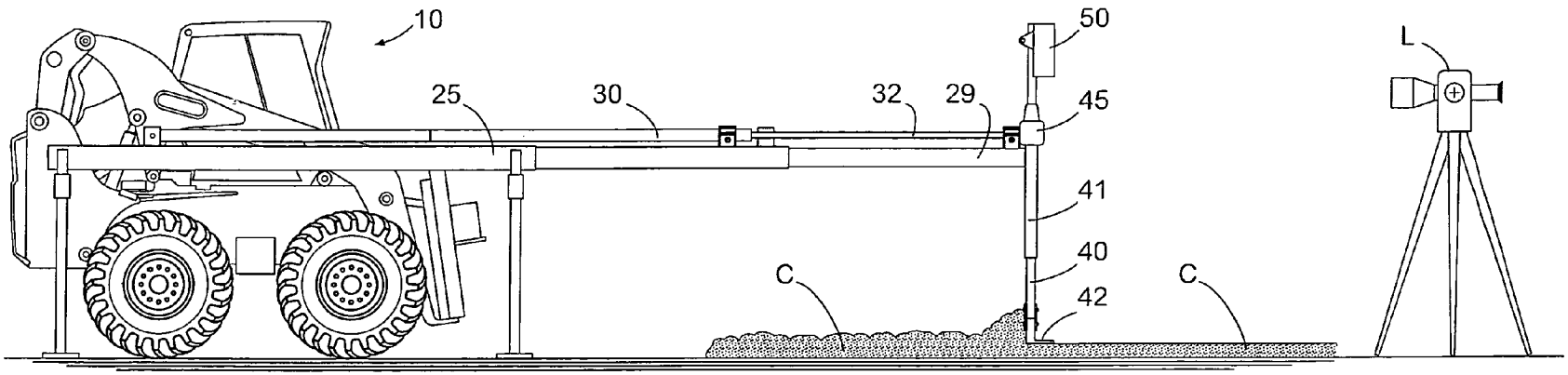
FIG. 8 is a side view of the skid steer and screed attachment with the screed plate in its extended position over a poured slab.

The sensors 50 receive laser signals from a transmitter L that is stationed in proximity of the poured concrete C, as shown in FIG. 8. The transmitter and sensor system may be of any suitable type, including systems that provide visual indications to the vehicle operator and systems that automatically adjust the position of the screed plate. One suitable system the Depthmaster MC200 or the Leica Basic Grading System produced by Leica Geosystems AG of St. Gallen, Switzerland. The system may include automated controllers 78 that are supported on the transverse beam 36 so that the controllers are immediately accessible to an operator seated in the cab 13 of the skid steer vehicle 10. The controllers 78 allow the operator to adjust the height of one side or the other of the screed plate in response to visual indications on the sensors 50. In other embodiments, the entire screed plate height adjustment process is fully automated. The electrical wiring associated with the laser sensors 50 may be carried by a cable track 60 that extends as the working components are cantilevered over the poured slab.

The present invention provides a screeding apparatus that is extremely well-suited for residential and small commercial applications, such for poured driveways, patios and sidewalks. The screed attachment 20 may be adapted to mount on any industrial vehicle, such as the skid steer vehicles frequently used at residential and commercial job sites. The screeding attachment may be transported to a job site and readily engaged to the skid steer vehicle by simply driving the vehicle into the attachment, as explained above. With the attachment elevated by the power mechanism of the vehicle, the vehicle can travel to the pour location and calibrated to the laser leveler, such as the leveler L shown in FIG. 8. With the screeding apparatus in position, the concrete is poured and prepared for screeding. With the screed plate 42 elevated, the extendable beams 29 are driven forward by the cylinder 30 and piston 32 until the screed plate is at the distal edge of the pour. The motors 45 are then activated to lower the screed plate 42, which also lowers the sensors 50 until they are properly positioned as indicated by the laser leveling system.

The screed attachment is then ready to operate to screed the poured concrete. The operator then activates the cylinders 32 to retract the extendable beams 29 and with them the screed plate 42. Various speed governors and feedback systems may be provided to control the action of each cylinder to ensure that the screed plate 42 is pulled over the concrete in a uniform manner. If the concrete is intended to be screeded at a grade, the operator monitors the indicators on the laser sensors 50 to determine when to lower the screed plate. Once one segment of the concrete pour has been completed, the screed plate is raised and the vehicle maneuvered into position adjacent the newly screeded portion to screed the next concrete pour.

Prior screed attachments require that the vehicle be driven to drag the screed plate over the newly poured concrete. With the present invention, the vehicle is stationary and the screed attachment is stably supported by its own legs. The movement of the screed plate can thus be accurately controlled, as opposed to the gross control available by the moving vehicle approach of the prior art.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A screed attachment for an industrial vehicle having an attachment point at one end of the vehicle for accessories and a power mechanism for moving the attachment point, said screed attachment comprising:

a pair of extendable beam assemblies, each assembly including a fixed beam, an extendable beam and a mechanism for extending and retracting said extendable beam relative to said fixed beam in a direction extending outwardly away from the one end of the industrial vehicle;

a mounting structure connected between said pair of extendable beam assemblies and having a portion configured to engage the attachment point of the industrial vehicle to support said beam assemblies on the industrial vehicle; and a screed plate carried by a free end of said extendable beam of each of said extendable beam assemblies to be translated in said direction relative to the industrial vehicle.

2. The screed attachment of claim 1, further comprising a plurality of legs with ground-engaging feet connected to said fixed beam of each of said pair of beam assemblies to support said extendable beam assemblies.

3. The screed attachment of claim 1, wherein said mounting structure includes a mechanism for moving said screed plate relative to the industrial vehicle in a vertical direction relative to the ground.

4. The screed attachment of claim 3, wherein said mechanism includes a vertically movable piston and a drive mechanism for extending and retracting each piston connected to opposite ends of said screed plate.

5. The screed attachment of claim 4, wherein said drive mechanism includes a motor for extending and retracting said vertically movable piston.

6. The screed attachment of claim 3, further comprising a level sensing system for comparing the vertical position of said screed plate relative to a pre-determined vertical position.

7. The screed attachment of claim 6, wherein said level sensing system includes a pair of posts carrying a corresponding sensor supported adjacent the opposite ends of said screed plate to move vertically therewith, said corresponding sensor operable to receive a signal from a remote leveler transmitter.

8. The screed attachment of claim 7, wherein said level sensing system includes a control panel supported on said mounting structure so that said control panel is manually accessible from within the cab of the industrial vehicle.

9. The screed attachment of claim 1, wherein said mechanism for extending and retracting includes a hydraulic cylinder and piston attached between said fixed beam and said extendable beam of each of said pair of extendable beam assemblies.

10. The screed attachment of claim 1, wherein said mounting structure includes:

a pair of brackets, each pivotably connected at a corresponding opposite end of said screed plate; and a pair of vertical supports connecting each of said pair of brackets with said extendable beam of a corresponding one of said pair of extendable beam assemblies.

11. The screed attachment of claim 10, wherein each of said pair of vertical supports includes:

a telescoping beam arrangement attached at one end to said extendable beam and attached at an opposite end thereof to one end of a corresponding one of said pair of brackets; and a mechanism for moving said screed plate vertically relative to the industrial vehicle connected to an opposite end of said corresponding one of said pair of brackets.

12. The screed attachment of claim 11, wherein said mechanism includes a vertically movable piston and a drive mechanism for extending and retracting said piston.

13. The screed attachment of claim 10, wherein:

each bracket includes a pivot bore and said screed plate defines a corresponding bore; and said mounting structure includes a pin and cotter pin assembly configured to extend through said pivot bore and said corresponding bore to removably pivotably connect each bracket to said screed plate.

14. The screed attachment of claim 2, wherein each of said plurality of legs include an outrigger assembly adjustably connecting said corresponding leg to said fixed beam of a corresponding one of said pair of extendable beam assemblies.

15. A screed attachment for an industrial vehicle having an attachment point for accessories and a power mechanism for moving the attachment point, said screed attachment comprising:

a pair of extendable beam assemblies, each assembly including a fixed beam, an extendable beam and a mechanism for extending and retracting said extendable beam relative to said fixed beam;

a mounting structure connected between said pair of extendable beam assemblies and having a portion configured to engage the attachment point of the industrial vehicle; and a screed plate carried by a free end of said extendable beam of each of said extendable beam assemblies, wherein said mounting structure includes a beam connected to said pair of extendable beam assemblies and configured to support said pair of extendable beam assemblies at a spacing sufficient for the industrial vehicle to drive between said beam assemblies.

16. A screed attachment for an industrial vehicle having an attachment point for accessories and a power mechanism for moving the attachment point, said screed attachment comprising:

a pair of extendable beam assemblies, each assembly including a fixed beam, an extendable beam and a mechanism for extending and retracting said extendable beam relative to said fixed beam;

a mounting structure connected between said pair of extendable beam assemblies and having a portion configured to engage the attachment point of the industrial vehicle;

a screed plate carried by a free end of said extendable beam of each of said extendable beam assemblies;

a plurality of legs with ground-engaging feet connected to said fixed beam of each of said pair of beam assemblies to support said extendable beam assemblies, at least the rearmost two of said plurality of legs including an outrigger assembly adjustably connecting said corresponding leg to said fixed beam of a corresponding one of said pair of extendable beam assemblies; and counterweights configured to be supported by said outrigger assembly of said at least the rearmost two of said plurality of legs to counterbalance the screed attachment supported at the attachment point of the vehicle.

* * * * *